US008041065B2

(12) United States Patent
Akino

(10) Patent No.: US 8,041,065 B2
(45) Date of Patent: Oct. 18, 2011

(54) MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1026 days.

(21) Appl. No.: 11/924,962

(22) Filed: Oct. 26, 2007

(65) Prior Publication Data

US 2008/0101630 A1 May 1, 2008

(30) Foreign Application Priority Data

Oct. 31, 2006 (JP) ..... 2006-295274

(51) Int. Cl.
*H04R 9/08* (2006.01)

(52) U.S. Cl. ..... 381/356; 381/173; 381/174

(58) Field of Classification Search ..... 381/355–361, 381/173–174

See application file for complete search history.

(56) References Cited

U.S. PATENT DOCUMENTS

| | | | | |
|---|---|---|---|---|
| 6,985,597 | B2 * | 1/2006 | Akino | 381/174 |
| 7,773,762 | B2 * | 8/2010 | Akino | 381/174 |
| 2008/0101630 | A1 * | 5/2008 | Akino | 381/190 |

FOREIGN PATENT DOCUMENTS

| | | |
|---|---|---|
| JP | 6-339192 | 12/1994 |
| JP | 7-143595 | 6/1995 |
| JP | 2005-184347 | 7/2005 |

OTHER PUBLICATIONS

U.S. Appl. No. 11/477,914, filed Jun. 30, 2006.

* cited by examiner

*Primary Examiner* — Richard A. Booth
(74) *Attorney, Agent, or Firm* — Oblon, Spivak, McClelland, Maier & Neustadt, L.L.P.

(57) ABSTRACT

The acoustic resistance inside the microphone of the present invention can be adjusted mechanically by a simple electrical operation from the outside, and thereby directivity can be changed easily without adversely affecting the acoustic characteristic, even if the microphone is a single directivity dynamic type microphone. The microphone has a front acoustic terminal and a rear acoustic terminal, and makes directivity variable by having an acoustic resistance changing unit of the rear acoustic terminal. The acoustic resistance changing unit has a piezoelectric element arranged in opposition to the rear acoustic terminal with an air layer in between, and makes the acoustic resistance of the rear acoustic terminal variable by varying a voltage to be applied to the piezoelectric element. The rear acoustic terminal opens in a flat part formed in a microphone unit constituent part, and it is recommended to arrange the acoustic resistance changing unit with a narrow air layer between the flat part and the acoustic resistance changing unit.

7 Claims, 10 Drawing Sheets

MICROPHONE

BACKGROUND OF THE INVENTION

1. Field of the Invention

The present invention relates to a microphone the directivity of which has been made variable by making acoustic resistance variable.

2. Related Background of the Invention

In a single directivity condenser microphone having a front acoustic terminal and a rear acoustic terminal, it is possible to change its directivity by changing the acoustic resistance of the rear acoustic terminal. If the acoustic resistance of the rear acoustic terminal is reduced (lowered), more speed components of sound waves can be taken in and thereby the directivity becomes more bidirectional. If the acoustic resistance of the rear acoustic terminal is increased (raised), a heart-shaped curve indicative of the directivity characteristic changes into a hyper cardioid, a cardioid, and a sub-cardioid, and the microphone becomes more omnidirectional and if the acoustic resistance is extremely raised, the directivity becomes omnidirectional.

In the case of a single directivity dynamic microphone, it is possible to change its directivity by changing the acoustic resistance between a diaphragm and a rear air chamber. However, in order to obtain omnidirectivity, it is necessary to close the rear acoustic terminal.

As conventional examples of a variable directivity condenser microphone, there are examples described in Patent documents below. In Japanese Patent Laid-Open No. 2005-184347, an example is described, in which a variable directivity condenser microphone is configured by arranging insulating washers of a pair of condenser microphone elements back to back and coupling them via a coupling ring, and an elastic acoustic resistance material is disposed between both the insulating washers. In the assembly process, by adjusting the degree of tightening the respective insulating washers against the coupling ring, it is possible to change the amount of compression of the acoustic resistance material to change the acoustic resistance value and thus making the directivity variable. There is an advantage in that the acoustic resistance can be adjusted to obtain an excellent directivity by, for example, adjusting the degree of screwing one of the microphone elements against the coupling ring in a state in which the pair of condenser microphone elements continue to be coupled via the coupling ring.

Japanese Patent Laid-Open No. 7-143595 describes a variable directivity condenser microphone, in which a microphone unit is configured by coupling the two condenser microphone elements by a coupler with respective acoustic resistors facing each other, and the acoustic resistance material of the microphone unit constitutes a ladder-like acoustic circuit. There is an advantage in that a microphone having a stable characteristic on the whole can be provided easily by making an acoustic measurement of each element to confirm the tension of the diaphragm and variations in acoustic resistance before coupling the two elements by the coupler, and by combining elements having similar characteristics.

Japanese Patent Laid-Open No. 6-339192 describes a microphone unit accommodating a diaphragm, a back plate, a cover plate, etc. in a unit case, in which a path through which the back part of the back plate is communicated with the outside is formed and an adjustment mechanism that changes the acoustic impedance of the path is provided therein. As an example of the adjustment mechanism, an example is described, in which a path is provided in the cover plate, a bolt is screwed into the path, and the acoustic impedance of the path is changed by adjusting the degree of screwing the bolt.

The configurations to make the directivity of a microphone variable include a configuration in which a plurality of microphone units having different directivities are provided and the signal output of each unit is electrically added or subtracted, a configuration in which the distance between the front and rear acoustic terminals is made variable, etc., in addition to the various configurations described above. In addition, there is a variable directivity condenser microphone unit in which the polarity and voltage of a polarization voltage are changed.

SUMMARY OF THE INVENTION

The variable directivity microphone described above makes its directivity variable by adjusting the acoustic resistance by a mechanical operation mainly when assembling the microphone unit or microphone, but it is not possible to change the directivity arbitrarily after assembling. Even if the directivity can be changed, a large-scaled task is required.

A microphone, the directivity of which is made electrically variable, is provided with a plurality of microphone units and the signal output of each unit is electrically added or subtracted, or the polarity and voltage of the polarization voltage are changed, and therefore, it is not possible to sufficiently exhibit the originally possessed characteristics of the microphone unit because the acoustic characteristic is affected by an electrical operation.

In the case of the single directivity dynamic microphone, because it is necessary to bring the air chamber at the rear part of the microphone unit into a hermetically sealed state, it is very difficult to make the directivity variable in the single directivity dynamic microphone.

An object of the present invention is to provide a microphone capable of solving the problems of the conventional variable directivity microphone.

More specifically, an object thereof is to provide a microphone, in which the acoustic resistance inside the microphone can be adjusted mechanically by a simple electrical operation from the outside, and thereby directivity can be changed easily without adversely affecting the acoustic characteristic, even if the microphone is a single directivity dynamic type microphone.

An object of the present invention is to provide a microphone having a front acoustic terminal and a rear acoustic terminal and making directivity variable by having an acoustic resistance changing unit, and wherein the acoustic resistance changing unit has a piezoelectric element arranged in opposition to an air layer in between; and an acoustic resistor is made variable by varying a voltage to be applied to the piezoelectric element.

The piezoelectric element deforms into a recurved shape when a voltage is applied and the direction of recurving differs depending on the direction of a voltage to be applied and the amount of recurving increases as the voltage is increased. Because of this, it is possible to change the directivity of a microphone by adjusting the acoustic resistance by the switching of the directions of a voltage to be applied to the piezoelectric element and the adjustment of the voltage. Since the switching of the directions of the voltage to be applied to the piezoelectric element and the adjustment of the voltage can be made from the outside of the microphone, the directivity can be changed easily even in the case of a dynamic microphone in which the air chamber at the rear part of the microphone unit is hermetically sealed.

The operation to change directivity is the electrical operation of switching the polarities of the voltage to be applied to the piezoelectric and adjusting the voltage, and the directivity is changed mechanically, and therefore, the acoustic characteristic is not affected adversely.

BRIEF DESCRIPTION OF THE DRAWINGS

FIG. 10 is a conceptual diagram showing a general configuration of a bimorph type vibrator available as an acoustic resistance changing unit in the present invention, wherein FIG. 10A shows a parallel type and FIG. 10B shows a series type.

DESCRIPTION OF THE PREFERRED EMBODIMENTS

Embodiments of a microphone according to the present invention will be described below with reference to the drawings.

First Embodiment

Figure 1:
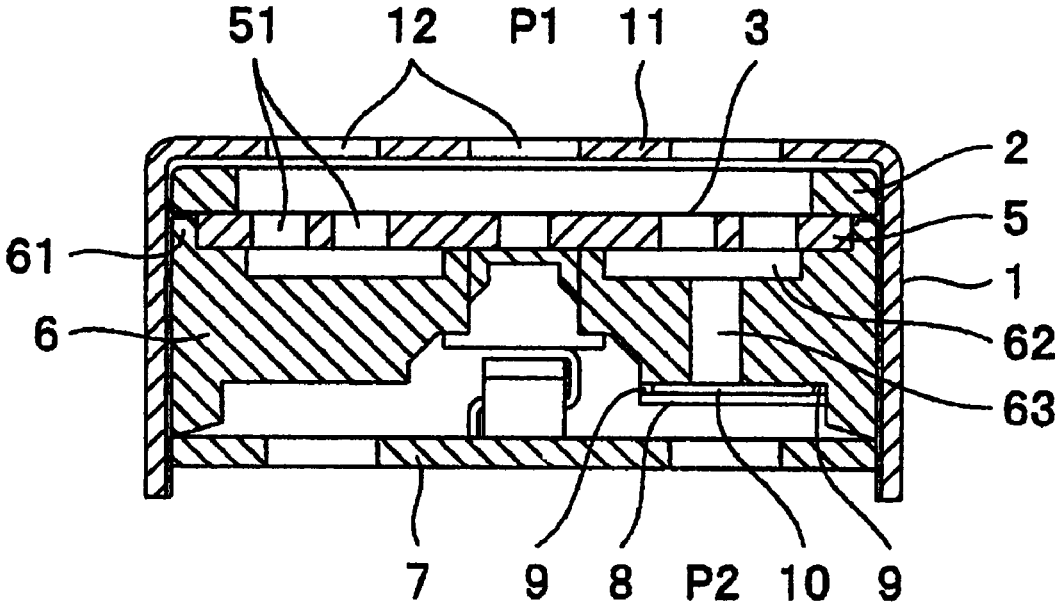
FIG. 1 is a longitudinal sectional view showing an embodiment of a microphone unit used in a microphone according to the present invention.
Figure 2:
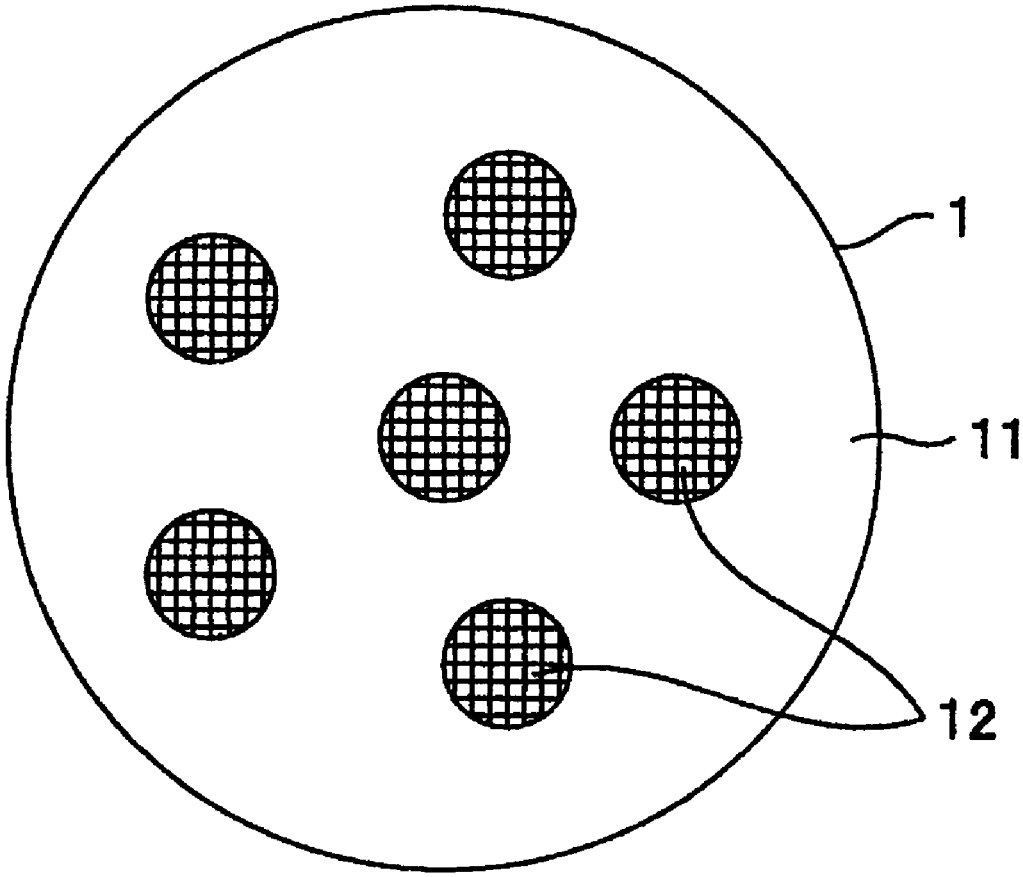
FIG. 2 is a front view of the embodiment.

First, an embodiment in which the present invention has been applied to a condenser microphone is described. FIG. 1 and FIG. 2 show an example of a condenser microphone unit. Reference numeral 1 shows a bottomed cylindrical unit case and the side of an end plate 11 corresponding to the bottom plate of the unit case 1 is the front side (upper side in FIG. 1) and the rear side in opposition thereto is an open end. In the end plate 11 of the unit case 1, a plurality of front acoustic terminals 12 constituted by circular holes are formed. On the inner side of the end plate 11, an acoustic resistor is arranged, however the acoustic resistor is not shown schematically. Inside the unit case 1, in the order from the top in FIG. 1, a diaphragm 3 having the circumferential part held by a ring-like diaphragm holding body 2, a ring-like spacer, a circular fixed electrode 5, a circular insulating washer 6, and a circuit substrate 7 are inserted. Since the spacer is a film-like thin member, it cannot be identified in the figure. Each of the above-mentioned built-in parts is fixed by a proper fixing unit in a state being accommodated in the unit case 1. In the example shown schematically, the open end edge of the unit case 1 is bent inward, and the circuit substrate 7 is pushed upward in FIG. 1, and each member is pressed in order, and thus the built-in parts are fixed.

The diaphragm 3 is fixed on the lower surface side of the diaphragm holding body 2 in FIG. 1 and an air chamber, the width of which is greater than the thickness of the diaphragm holding body 1, is formed between the inner surface of the end plate 11 and the diaphragm 3 by the top surface circumferential edge part of the diaphragm holding body 2 coming into contact with a proper contact part within the unit case 1. In the top end surface of the insulating washer 6, a recess part is formed by cutting out it into a two-step shape, leaving the circumferential edge part, and on the top end circumferential edge part, a circular projection 61 is formed. The fixed electrode 5 is fitted into the projection 61 and the outer surface of the fixed electrode 5 comes into contact with the inner surface of the projection 61 to position the fixed electrode 5. The height dimension of the projection 61 is less than thickness of the fixed electrode 5, and the top end surface of the fixed electrode 5 projects above the top surface of the projection 61. On the top surface circumferential edge part of the fixed electrode 5, a ring-like spacer, not shown explicitly, is placed and on the spacer, the circumferential edge part of the diaphragm 3 is placed. As a result, a small gap, corresponding to the thickness of the spacer, is formed between the diaphragm 3 and the fixed electrode 5, enabling the diaphragm 3 to vibrate in the range of the gap. The spacer includes an insulating film etc.

In the fixed electrode 5, a plurality of holes 51 that penetrate through the electrode in the direction of thickness is formed. The holes 51 are communicated with an air chamber 62 formed by the fixed electrode 5 inserted into the recess part formed stepwise in the insulating washer 6. The air chamber 62 is further communicated with a plurality of rear acoustic terminals 63 composed of holes formed so as to penetrate through the insulating washer 6 vertically. The lower end of the rear acoustic terminal 63 is open in a flat part formed on the lower surface side of the insulating washer 6. As a result, the opening is communicated with a space on the backside of the diaphragm 3 constituting the microphone unit. A piezoelectric element 8 is arranged as an acoustic resistance changing unit, in opposition to the opening and with a narrow air layer 10 between the flat part and the piezoelectric element 8.

Figure 10:
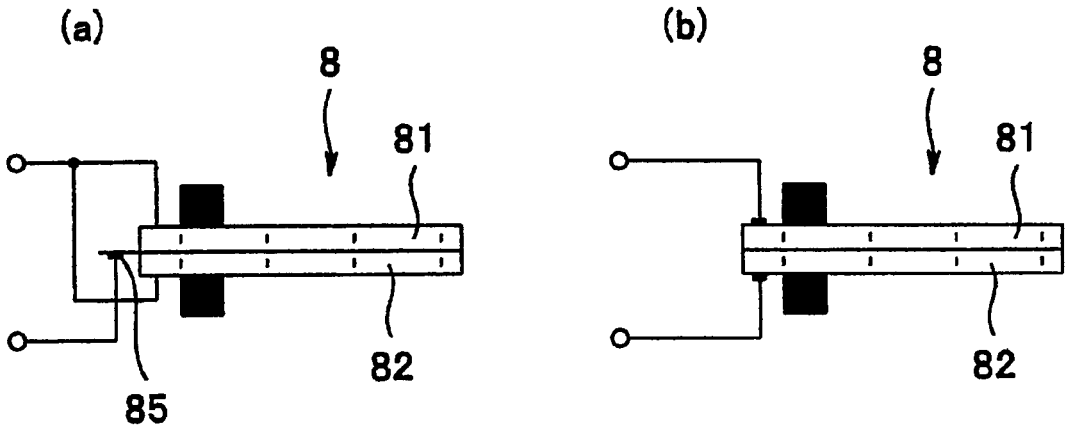

As the piezoelectric element 8, a bimorph vibrator can be used. FIG. 10 shows an outline of a bimorph vibrator, which is configured by joining two piezoelectric elements 81, 82, which expand and contract in the length direction in an overlapping manner. By applying a voltage between both the piezoelectric elements, one of the piezoelectric elements expands, and the other piezoelectric element contracts. The direction of polarization of each piezoelectric element is the direction of thickness. FIG. 10A shows a parallel type, in which the electrode, at which the two piezoelectric elements 81, 82 overlap with each other, is used as an intermediate electrode 85 and a voltage source is connected between the intermediate electrode 85 and the other electrode of the piezoelectric elements 81, 82, and a voltage is applied to the two piezoelectric elements 81, 82 in parallel. FIG. 10B shows a series type, in which a voltage source is connected between the electrodes outside the two piezoelectric elements 81, 82 overlapping with each other and a voltage is applied to the two piezoelectric elements 81, 82 in series. In either type, when a voltage is applied, one of the piezoelectric elements expands and the other piezoelectric element contracts, and thereby the piezoelectric element 8 recurves upward or downward in FIG. 10.

Figure 4:
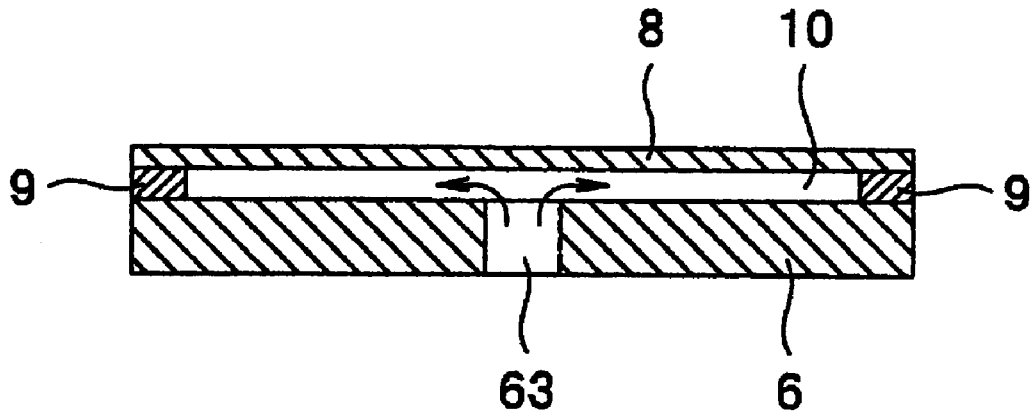
FIG. 4 is an enlarged longitudinal sectional view showing an acoustic resistance changing unit upside down used in the embodiment.
Figure 5:
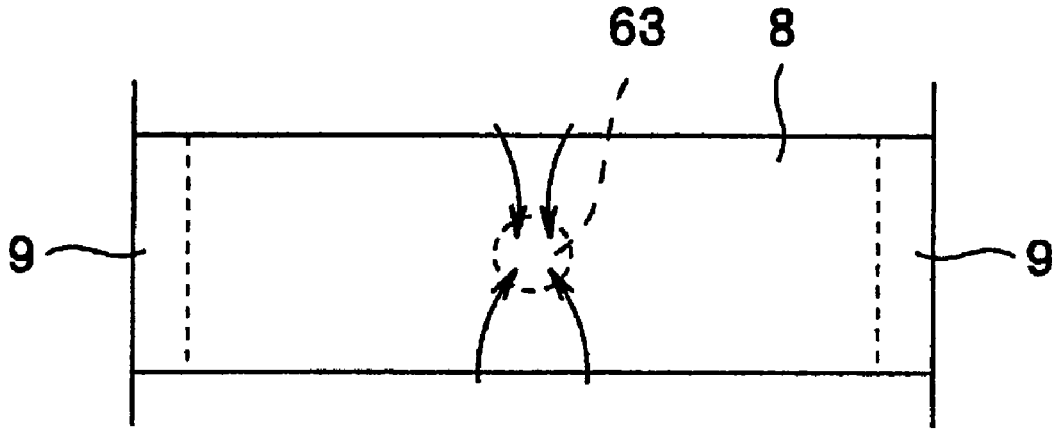
FIG. 5 is a front view of the acoustic resistance changing unit.

Returning to FIG. 1, both end parts of the piezoelectric element 8 are fixed in opposition to the opening of the rear acoustic terminal 63 in the flat part of the insulating washer 6 with the interposition of a spacer 9. Between the opening of the rear acoustic terminal 63 and the piezoelectric element 8, the air layer 10 with a small amount of clearance is formed. When a voltage is applied between the terminals of the piezoelectric element 8, the piezoelectric element 8 recurves. FIG. 4 to FIG. 7 show the configuration and operation of the piezoelectric element 8 as an acoustic resistance changing unit. FIG. 4 is an enlarged view when no voltage is applied to the piezoelectric element 8 and the relationship in the vertical direction is upside down to that in FIG. 1. On the flat part of the insulating washer 6, both end parts of the piezoelectric element 8 are fixed with the interposition of the spacers 9, 9. The piezoelectric element 8 is arranged with the narrow air layer 10, corresponding to the thickness of the spacers 9, 9 between the flat part of the insulating washer and the piezoelectric element 8. The piezoelectric element 8 does not recurve but remain parallel to the flat part of the insulating washer 6, setting the acoustic resistance of the rear acoustic terminal 63 to an acoustic resistance of intermediate level.

Figure 6:
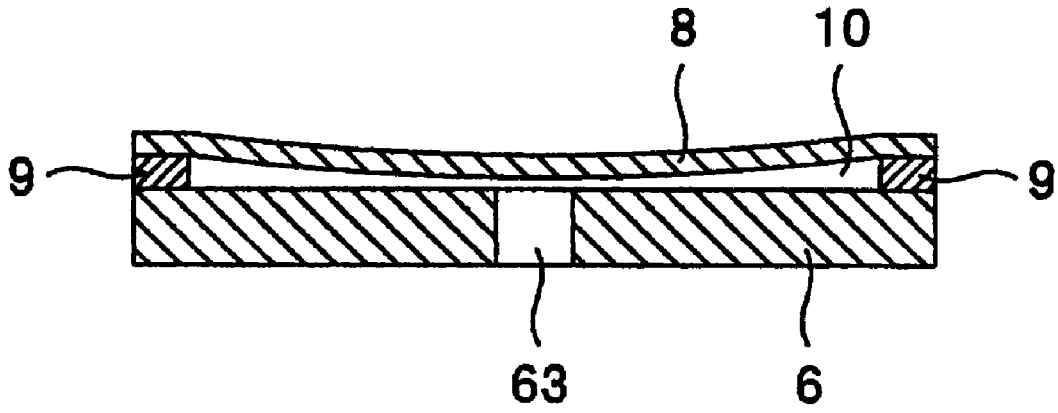
FIG. 6 is a longitudinal sectional view showing an example of how the acoustic resistance changing unit operates following FIG. 4.
Figure 7:
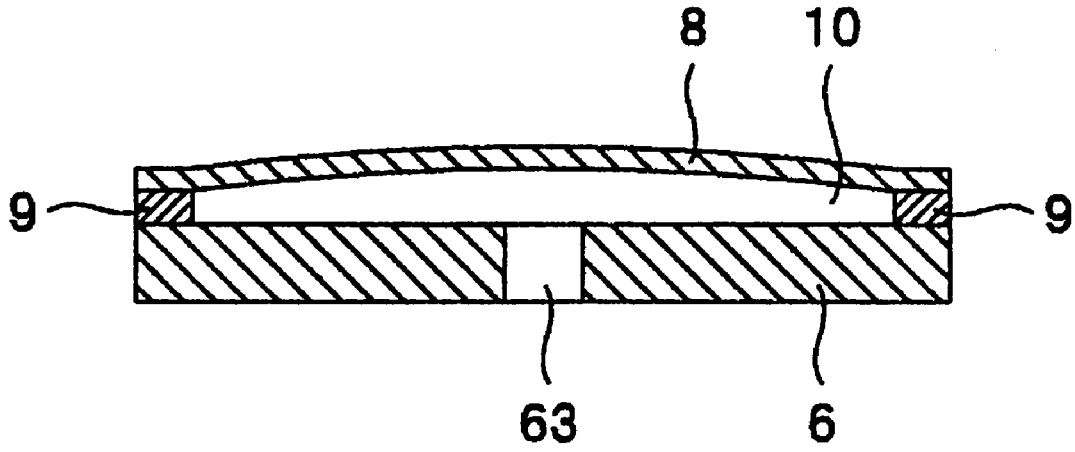
FIG. 7 is a longitudinal sectional view showing another example of how the acoustic resistance changing unit operates following FIG. 4.

FIG. 6 shows a state in which a voltage is applied to the piezoelectric element 8 to recurve the piezoelectric element 8 toward the rear acoustic terminal 63. In this state, the flow of air between the rear acoustic terminal 63 and the air layer 10 is restricted and the acoustic resistance of the rear acoustic terminal 63 increases. As a result, the directivity of the microphone unit tends to become more omnidirectional. FIG. 7 shows a state in which a voltage is applied to the piezoelectric element 8 in the opposite direction to recurve the piezoelectric element 8 toward the direction becoming more distant from the rear acoustic terminal 63. In this state, the flow of air between the rear acoustic terminal 63 and the air layer 10 is promoted and the acoustic resistance of the rear acoustic terminal 63 decreases. As a result, the directivity of the microphone unit tends to become more bidirectional.

Figure 3:
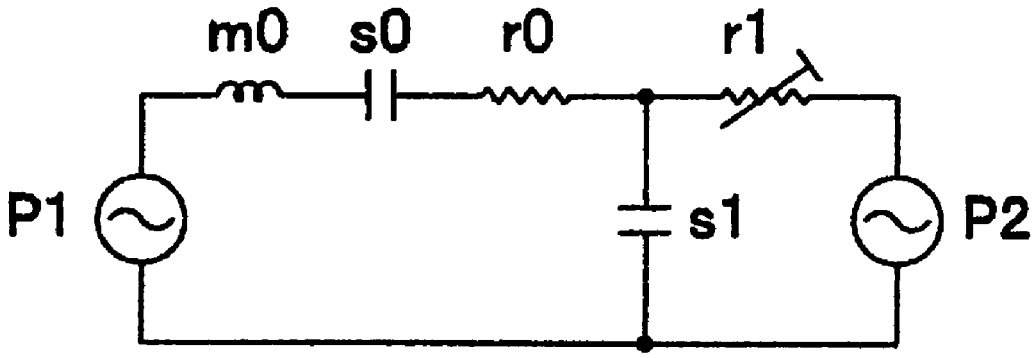
FIG. 3 is an acoustically equivalent circuit diagram of the embodiment.

FIG. 3 shows an acoustically equivalent circuit of the embodiment. Acoustic elements of each part in the above embodiment are defined as follows.

P1: Sound pressure on the front side of the unit
P2: Sound pressure on the rear side of the unit
m0: Acoustic mass of the diaphragm
s0: Stiffness of the diaphragm
r0: Acoustic resistance of the diaphragm
s1: Stiffness of the air chamber 62 behind the diaphragm 3
r1: Acoustic resistance of the air layer 10

The equivalent circuit can be represented in a form in which P1, m0, s0, r0, r1, and P2 are connected in series in this order and s1 is connected between the connection point of r0, r1 and the connection point of P1, P2, that is, the ground. It is possible to switch between the direction of increasing the acoustic resistance of the rear acoustic terminal as shown in FIG. 6 and the direction of decreasing the acoustic resistance of the rear acoustic terminal as shown in FIG. 7 by the direction of the voltage to be applied to the piezoelectric element 8, and thus to adjust the acoustic resistance continuously by adjusting the voltage to be applied. In the equivalent circuit shown in FIG. 3, the change in r1 changes the acoustic resistance of the rear acoustic terminal. Due to this, it is possible to change the directivity of a microphone continuously from omnidirectivity to bidirectivity.

According to the embodiment described above, it is possible to make directivity variable by switching the directions of the voltage to be applied to the piezoelectric element and by adjusting the voltage, and therefore, there is an advantage that directivity can be changed by a simple operation from the outside of a microphone. Since directivity is changed mechanically by the operation of the piezoelectric element, it is unlikely that the acoustic characteristic is adversely affected.

It is recommended to obtain a power source for applying a voltage to the piezoelectric element 8 from a phantom power source generally used in a condenser microphone. Since the piezoelectric element 8 does not consume electric power, it is possible to adjust the acoustic resistance properly only by adjusting the voltage of a phantom power source and applying it to the piezoelectric element 8. It is also possible to change the acoustic resistance continuously by changing the voltage to be applied to the piezoelectric element 8 continuously using a variable resistor. It is recommended to supply the voltage to be applied to the piezoelectric element 8 through the circuit substrate 7 arranged in the vicinity of the piezoelectric element 8. A condenser microphone can be configured by incorporating the microphone unit shown in FIG. 1, FIG. 2 in a microphone case and further incorporating necessary circuit substrate, connector, etc., in the microphone case.

Second Embodiment

Figure 8:
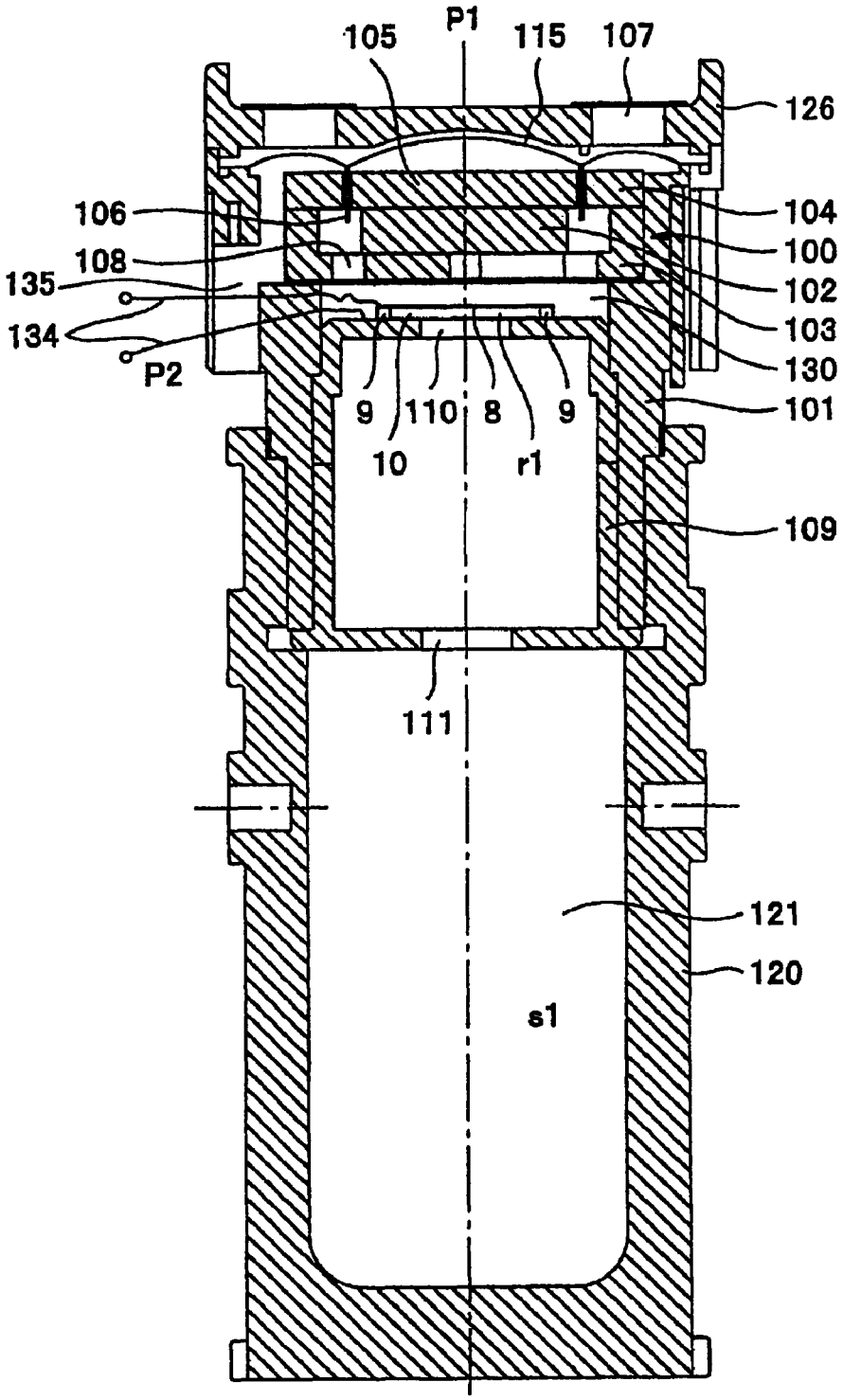
FIG. 8 is a longitudinal sectional view showing another embodiment of the microphone according to the present invention.

FIG. 8 shows an embodiment in which the present invention has been applied to a dynamic microphone. In FIG. 8, reference numeral 100 denotes a dynamic microphone main body. The cylindrical microphone unit main body 100 includes a center pole piece 105, a disc-like permanent magnet 102 on which the center pole piece 105 is fixed in an overlapping manner, a dish-like tail yoke 103 on which the permanent magnet 102 is fixed in an overlapping manner, and a ring-like side yoke 104 fixed on the circular top end surface of the tail yoke 103 and forming a circular magnetic gap between the inner surface and the outer surface of the center pole piece 105. The center pole piece 105, the permanent magnet 102, the tail yoke 103, and the side yoke 104 constitute a magnetic circuit. Into the magnetic gap of the magnetic circuit, a voice coil 106 fixed on a diaphragm 115 is inserted spaced from the center pole piece 105 and the side yoke 104. The unit main body 100 is engaged with and fixed on the top end part of the cylindrical unit holder 101. In the tail yoke 103, there are pluralities of sound holes 108 for causing the air chamber on the backside of the diaphragm 115 to be communicated with the rear via the magnetic gap.

The diaphragm 115 has a center dome and a sub dome provided integrally therearound and one end of the voice coil 106 is fixed on the backside of the diaphragm 115 along the boundary between the center dome and the sub dome. The peripheral part of the diaphragm 115 is fixed on the top end of the unit holder 101 and the diaphragm 115 is configured to be capable of vibrating together with the voice coil 106 in the longitudinal direction (in the vertical direction in FIG. 8) when receiving sound waves. The front surface of the diaphragm 115 is covered with the front acoustic terminal plate 126 fixed on the peripheral part of the front end of the unit holder 101. In the front acoustic terminal plate 126, a front acoustic terminal 107 including a plurality of holes is formed. In the outside part of the unit holder 101, an air hole communicated with the air chamber on the backside of the diaphragm 115 is formed and the air hole constitutes a rear acoustic terminal 135.

Into the rear part (lower part in FIG. 8) of the unit holder 101, a cylinder 109 having end plates on front and rear parts is inserted and the end plate on the front side of the cylinder 109 is in opposition to the back surface of the tail yoke 103 with an air chamber 130 in between. The cylinder 109 constitutes a backside air chamber of the microphone unit and in the end plate on the front side of the cylinder 109, an opening 110 is formed, which causes the air chamber 130 to be communicated with the backside air chamber. In FIG. 8, the periphery of the lower end part of the unit holder 101 is fitted into and fixed on the inner surface of the upper end part of a microphone case 120 and a hermetically sealed, large air chamber 121 is formed by the end plate on the lower side of the cylinder 109 fitted into the unit holder 101 and the microphone case 120. In the end plate on the lower side of the cylinder 109, an opening 111 is formed, which causes the air chamber formed by the cylinder 109 to be communicated with the air chamber 121.

The dynamic type microphone described so far has a configuration in which the hermeticity of the backside air chamber is high, and is basically a single directivity dynamic type microphone. In order to make the directivity of the microphone variable, the piezoelectric element 8 is arranged in the air chamber 130. More specifically, the piezoelectric element 8 is provided on the end plate on the upper side of the cylinder 109 as an acoustic resistance changing unit so that it is in opposition to the opening 110 and the air layer 10 being interposed in between with the end plate on the upper side of the cylinder 109. The piezoelectric element 8 has the configuration already described and its both end parts are attached to the end plate on the upper side of the cylinder 109 that forms a flat plane via the spacers 9, 9. The operation of the piezoelectric element 8 is also as described above, and a lead wire 134 for applying a voltage to the piezoelectric element 8 is led out from the piezoelectric element 8 to the outside of the microphone.

Figure 9:
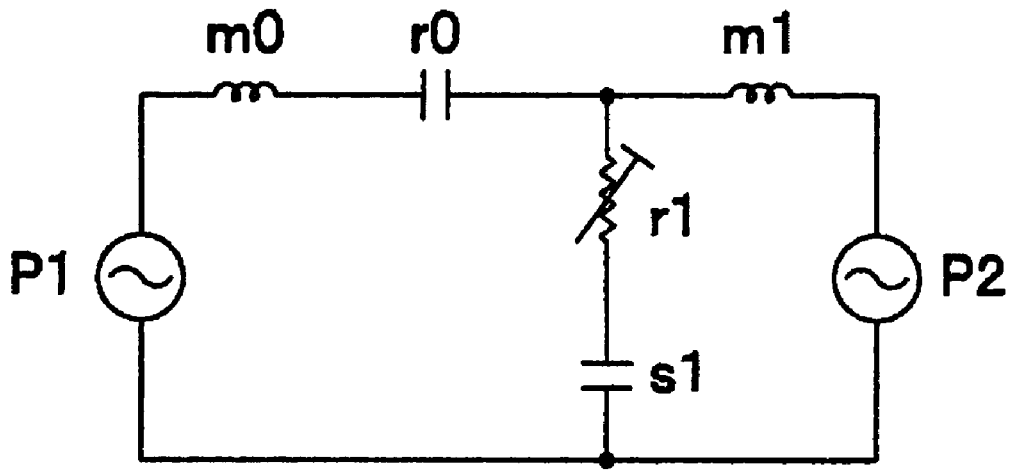
FIG. 9 is an acoustically equivalent circuit diagram in the embodiment.

An acoustically equivalent circuit of the embodiment shown in FIG. 8 is shown in FIG. 9. Acoustic elements in each part in the above embodiment are defined as follows.

P1: Sound pressure on the front side of the microphone unit
P2: Sound pressure on the rear side of the microphone unit
m0: Acoustic mass of the diaphragm
r0: Acoustic resistance of the diaphragm
s1: Stiffness of the air chamber 121
r1: Acoustic resistance of the air layer 10
m1: Acoustic mass of the rear acoustic terminal The equivalent circuit can be represented in a form in which P1, m0, r0, m1, and P2 are connected in series in this order and r1 and s1 are connected in series between the connection point of r0, m1 and the connection point of P1, P2, that is, the ground. It is possible to switch between the direction of increasing the acoustic resistance of the air layer 10 and the direction of decreasing the acoustic resistance of the air layer 10 by the direction of the voltage to be applied to the piezoelectric element 8, and to adjust the acoustic resistance continuously by adjusting the voltage to be applied. In the equivalent circuit shown in FIG. 9, r1 changes by the control of the piezoelectric element 8 and thus the acoustic resistance of air layer 10 changes. Due to this, it is possible to change the directivity of a microphone continuously from omnidirectivity to bidirectivity.

For a single directivity dynamic microphone, it is necessary to hermetically seal the rear part of its microphone unit, and therefore, it is very difficult to adjust an acoustic resistance changing unit for making directivity variable from the outside by a mechanical operation. However, according to the embodiment shown in FIG. 8, if the lead wire 134 for controlling the acoustic resistance value is led out to the outside, it is easy to keep hermeticity between the lead wire and the microphone unit, and therefore, it is possible to easily make the directivity of the single directivity dynamic microphone variable.

In general, an actuator utilizing a piezoelectric element is suitable for the control of a small displacement. For a bimorph type vibrator, it is possible to obtain an amount of displacement of about 0.1 mm with an applied voltage of 20 V, although depending on the conditions of attachment. In the above embodiment, the thickness (clearance) of the narrow air layer 10 is about 0.01 to 0.1 mm in the range used in a microphone, and therefore, a bimorph type vibrator is suitable for an element for controlling such a thickness. In the embodiment shown schematically, the thickness of the air layer 10 is shown exaggerated than an actual one for easy understanding of the configuration. The voltage to be applied to the piezoelectric element may be changed continuously, or changed in steps of a fixed voltage, for example, in steps of 2 V.

What is claimed is:

1. A microphone having a front acoustic terminal and a rear acoustic terminal and making directivity variable by having an acoustic resistance changing unit, wherein the acoustic resistance changing unit has a piezoelectric element arranged in opposition to an air layer in between; and an acoustic resistance is variable by varying a voltage to be applied to the piezoelectric element.

2. The microphone according to claim 1, wherein the microphone is a single directivity condenser microphone, and a flat part formed in a microphone unit constituent part is opened and serves as an acoustic terminal; and an acoustic resistance changing unit is arranged in opposition to the opening and with a narrow air layer between the flat part and the acoustic resistance changing unit.

3. The microphone according to claim 2, wherein a narrow air layer is formed between an acoustic resistance changing unit and the flat part by the interposition of a spacer between the acoustic resistance changing unit and the flat part.

4. The microphone according to claim 1, wherein the microphone is a single directivity dynamic microphone, and the air layer facing the piezoelectric element is communicated with a space behind a diaphragm constituting a microphone unit.

5. The microphone according to claim 1, wherein the microphone is a single directivity condenser microphone, and an opening provided in a fixed electrode arranged in opposition to a diaphragm is communicated with the rear acoustic terminal.

6. The microphone according to claim 1, wherein the microphone is a single directivity dynamic microphone, and a unit holder is arranged behind a microphone unit main body with an air chamber in between; and the acoustic resistance changing unit including a piezoelectric element formed in the unit holder and in opposition to an opening communicated with the air chamber.

7. The microphone according to claim 6, wherein the unit holder is in a state being sealed in a microphone case, an air chamber is formed in the microphone case behind the unit holder and fitted, and an internal space of the unit holder and the air chamber in the microphone case are communicated with each other through a sound hole formed behind the unit holder.

* * * * *